US006182405B1

(12) United States Patent
Lindahl

(10) Patent No.: US 6,182,405 B1
(45) Date of Patent: Feb. 6, 2001

(54) WINDOW FRAME STRUCTURE

(75) Inventor: Edmond Carl Lindahl, West Vancouver (CA)

(73) Assignee: Marzeu Artistic Aluminum LTD, Langley (CA)

( * ) Notice: Under 35 U.S.C. 154(b), the term of this patent shall be extended for 0 days.

(21) Appl. No.: 09/457,010

(22) Filed: Dec. 8, 1999

(51) Int. Cl.[7] ..... E06B 1/04

(52) U.S. Cl. ..... 52/204.1; 52/208; 52/204.2; 52/202; 52/204.591

(58) Field of Search ..... 52/204.1, 208, 52/204.55, 214, 204.591, 202, 209, 204.2

(56) References Cited

U.S. PATENT DOCUMENTS

| | | | | |
|---|---|---|---|---|
| 1,722,172 | * | 7/1929 | Benson | 52/204.2 |
| 2,918,708 | * | 12/1959 | Sharp et al. | 52/204.591 X |
| 2,983,001 | * | 5/1961 | Guldager | 52/207.591 X |
| 3,199,156 | * | 8/1965 | Riegelman | 52/204.2 |
| 3,466,819 | * | 9/1969 | Giger | 52/204.51 |
| 3,503,169 | * | 3/1970 | Johnson et al. | 52/504 |
| 3,774,360 | * | 11/1973 | Hubbard et al. | 52/127 |
| 4,003,171 | * | 1/1977 | Mitchell | 52/209 |
| 4,229,905 | * | 10/1980 | Rush | 49/143 |
| 4,237,664 | * | 12/1980 | Wilmes | 52/209 |
| 4,525,966 | * | 7/1985 | Litchfield et al. | 52/397 |
| 4,555,882 | * | 12/1985 | Moffitt et al. | 52/204 |
| 4,945,680 | * | 8/1990 | Giguere | 49/468 |
| 4,967,507 | * | 11/1990 | Visnic et al. | 49/504 |
| 5,212,921 | * | 5/1993 | Unruh | 52/204.1 |
| 5,325,648 | * | 7/1994 | Menard | 52/456 |
| 5,373,671 | * | 12/1994 | Roth et al. | 52/204.1 |
| 5,666,773 | | 9/1997 | Librande et al. . | |
| 6,098,355 | * | 8/2000 | Li | 52/212 |

FOREIGN PATENT DOCUMENTS

| | | | | |
|---|---|---|---|---|
| 3301176 | * | 7/1984 | (DE) | 52/204.2 |
| 26443 | * | 3/1978 | (JP) | 52/202 |

* cited by examiner

*Primary Examiner*—Carl D. Friedman
*Assistant Examiner*—Phi Dieu Tran A
(74) *Attorney, Agent, or Firm*—C. A. Rowley

(57) ABSTRACT

A window frame provided with a tapered sub-sill that is mounted on the wall and via a plurality of spaced spacers tapered in the opposite direction to support the main frame sill element in its substantially horizontal position. The use of the tapered sub-sill and tapered spacers permit the sealing membrane positioned between the wall structure and the wall facing to pass therebetween and provide a good seal and provide a solid base for the main sill. In the preferred arrangement, a snap in seal is connected to the outside bottom edge of the sill and forms a seal between the facing layer and the sill and provides a projecting flashing to redirect rain.

13 Claims, 4 Drawing Sheets

WINDOW FRAME STRUCTURE

FIELD OF INVENTION

The present invention relates to window frame structure, more particularly, the present invention relates to a sill structure facilitating draining and particularly adapted for use with walls with internal wall cavities.

BACKGROUND OF THE INVENTION

There are many, many different forms and shapes of window frame members generally made by extrusion aluminum or polyvinylchloride (PVC) that are connected together to form the window frame for mounting windows in position in the window opening.

U.S. Pat. No. 5,666,773 issued Sep. 3, 1997 to Librande et al. shows a number of different arrangements of extruded materials and their fabrication to form window frames. This patent discloses a tapered spacer element to mount a frame element on a sloping sill and uses extruded trim members to connect to the frame to trim the window frame to the surrounding wall structure.

BRIEF DESCRIPTION OF THE PRESENT INVENTION

It is an object of the present invention to provide an improved window frame structure particularly an improved sill structure.

It is a further object of the present invention to provide a snap-in seal that may be used particularly with cavity wall to seal the window frame to the wall facing around the periphery of the window.

Broadly, the present invention relates to a window frame comprising a sub-sill having a mounting surface for positioning in a window opening and a sloping surface extending in an acute angle from the side of the sub-sill that faces outward relative to the window opening when the sub-sill is mounted in the window opening. A plurality of discreet spacer elements overlie the sub-sill and are positioned in axially spaced relationship relative to the longitudinal axis of the sub-sill. A main sill has a main mounting surface, cooperating fastening elements on the main surface and is connected to the spacers by a snap type connection. The spacer position the main sill substantially parallel to said mounting surface and the main sill is connected to the sub-sill.

Preferably, said cooperating fastening elements providing the connection between said spacers and said main sill comprise a snap fits between an arm at one end of each of said spacers and a tongue and groove connection between said main sill and a second arm on each of said spacer adjacent an opposite end of said spacer to said one end.

Preferably, said main sill has a axially extending nailing strip projecting downwardly from said main sill and said snap fit between said one arm and said main sill employs an undercut on said nailing strip.

Preferably, said window frame further comprises a compression gasket, said compression gasket in place, said compression gasket having a rib at one end and a deflectable element at its opposite end, a groove in said main seal in which said rib is received when said gasket is mounted on said main sill and an undercut on said main seal into which said deflectable element is snaped over when said gasket is mounted on said main sill.

Preferably, said gasket includes plurality of deformable strips interconnected with said gasket and adapted to contact the facing portion of a wall.

Preferably, the compression gasket includes a flashing member projecting forward therefrom.

The present invention also relates to a wall structure having an air space positioned between a structural wall portion and a facing wall portion, a window opening through the wall. A window frame including a sub-sill having a mounting surface and a sloping support surface extending at an acute angle from said mounting surface is -sill mounted in the window opening and on the main supporting wall with said support surface sloping upward and inward relative to said window opening. A sealing membrane extends in said air space and is positioned against said structural wall portion and passes into the window opening over the sloping face of the sub-sill to provide a seal for said structural wall portion. A plurality of spaced tapered spacer elements are positioned in overlying relationship to the sloped wall and overlying membrane that extends up the sloped wall. Cooperating fastener elements releasable connect each of the spacer members to a main sill member and a connector connects said main sill member to said sub-sill member.

Preferably said main sill member has an axially and downwardly extending nailing flange that passes into said air space and is positioned against said membrane immediately adjacent to said window opening in said air space.

Preferably, said structure further includes a compressible gasket and a releasable connection connecting said compressible seal to said main seal.

Preferably, said compressible gasket includes a flashing projecting outwardly of said wall.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
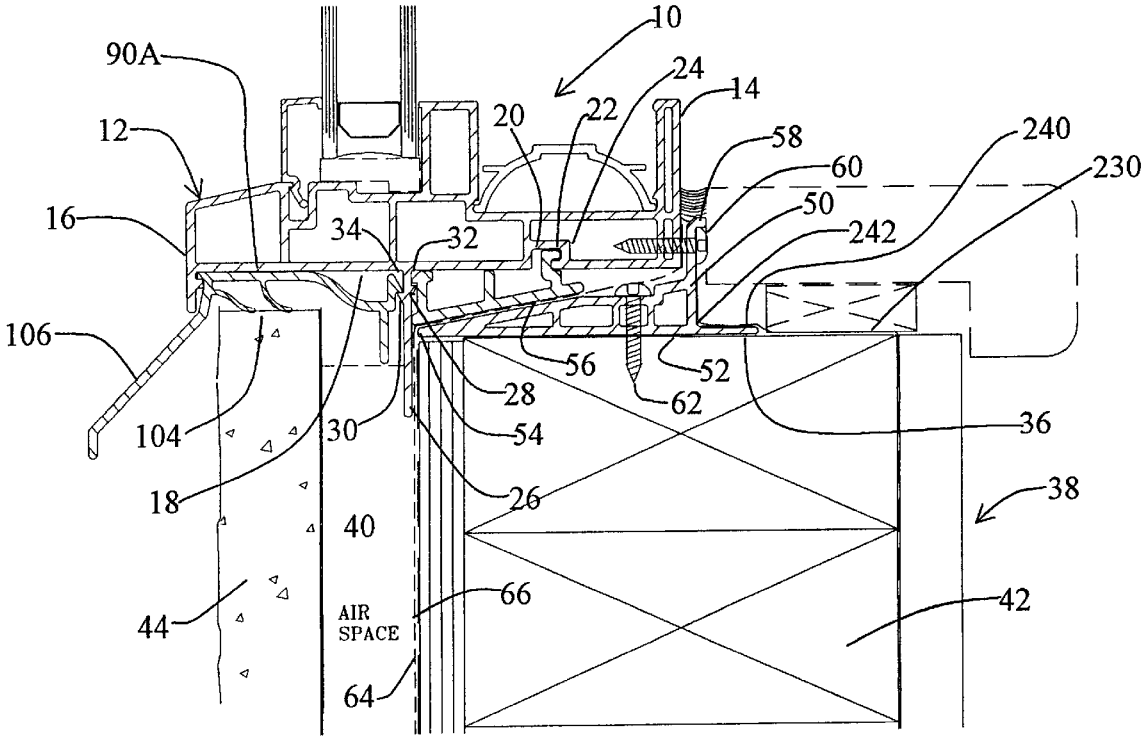
FIG. 1 is a side elevation of the sill structure of the present invention.
Figure 2:
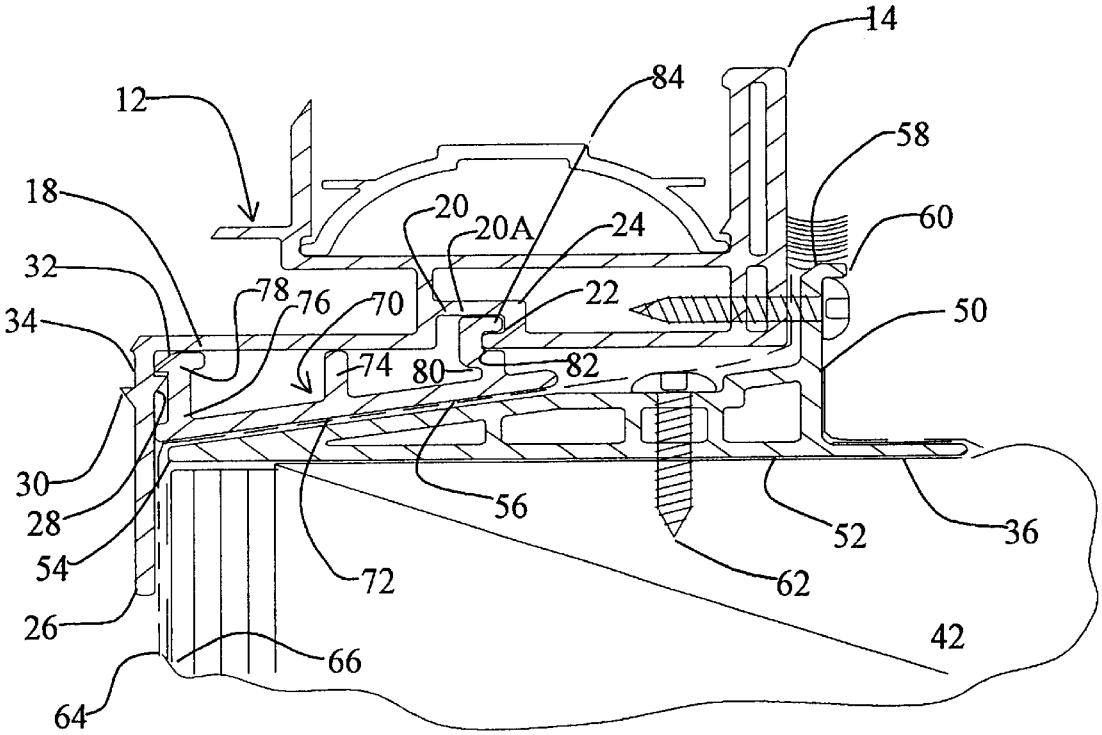
FIG. 2 is an enlarged cross-section showing a portion of the main frame member and how it cooperates with the sub-sill and spacers of the present invention.
Figure 3:
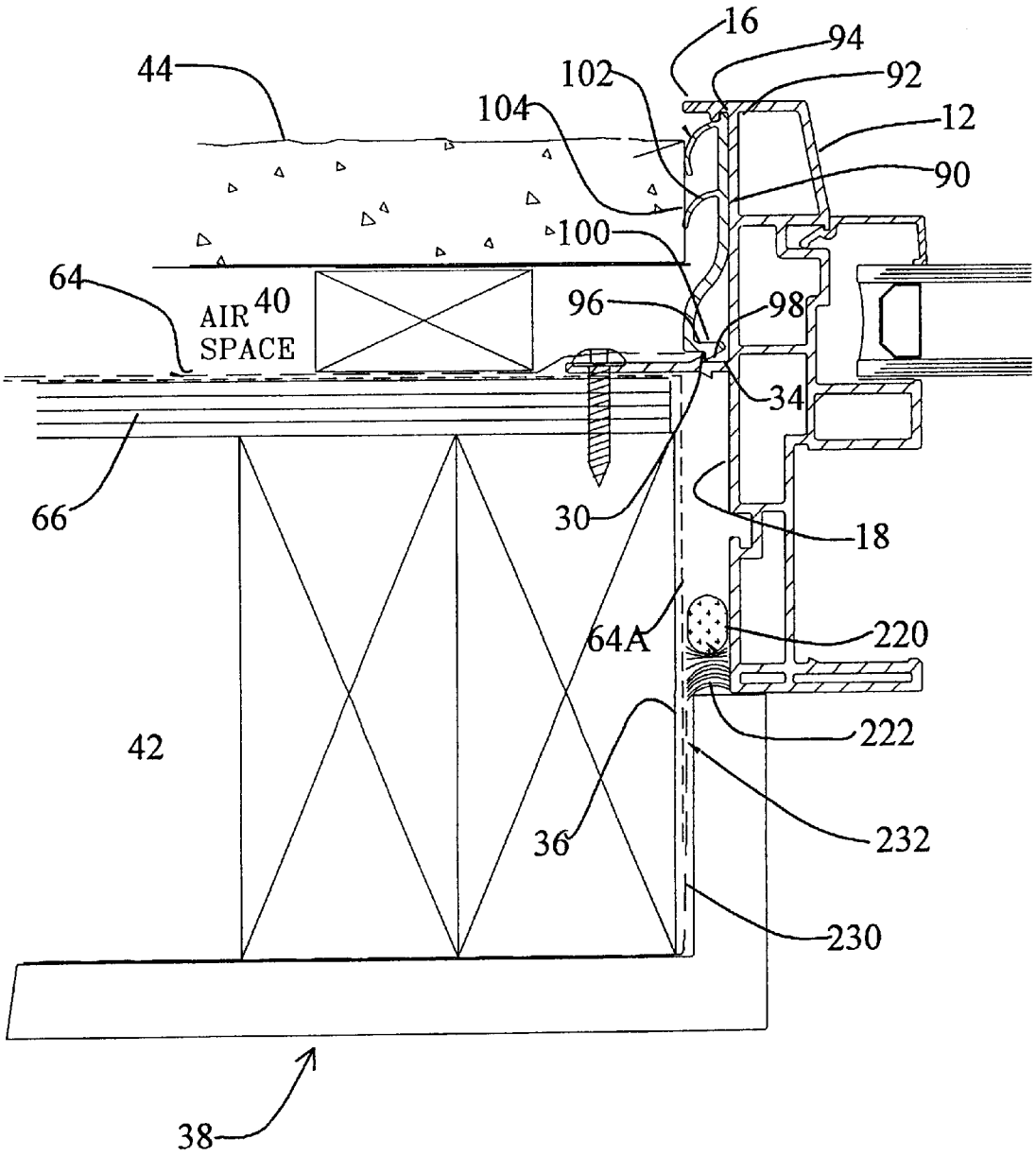
FIG. 3 is a section in plan showing the side jam construction particularly suited for use in combination with the sill of FIG. 1.
Figure 4:
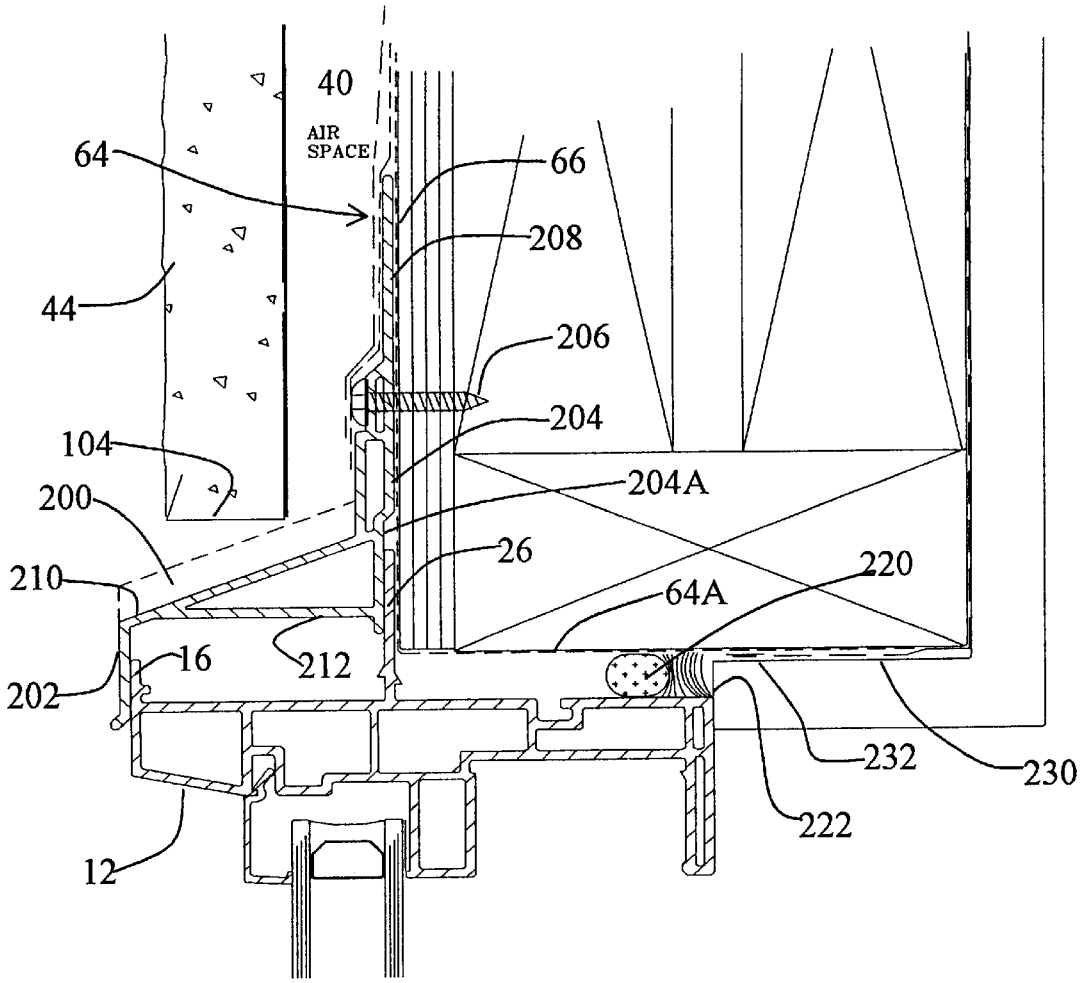
FIG. 4 is a vertical section through the window frame illustrating a head construction particularly suited for use with the present invention on cavity walls.

The window frame 10 of the present invention is composed of a main element 12 which forms the main sill element 12 in the sill structure shown in FIGS. 1 and 2, the main jam member in the jam structure shown in FIG. 3 and the main head member 12 in the head structure shown in FIG. 4. This main element 12 in the illustrated arrangement is a hollow body having an inner flange 14 and an outer flange 16, the inner flange 14 is positioned at the innermost side of the structure and projects upward relative to the window frame and the outer flange 16 is at the outermost side of the member 12 and projects downward relative to the window frame. The main mounting surface 18 of the member 12 is provided with a formed cavity 20 with a tongue 22 projecting into the cavity 20 toward the outmost side of the member 12 and extending substantially parallel to the surface 18 from an inner wall 24 of the cavity 20 that is closest to the flange inside 14.

About mid-width of the member 12 is a mounting flange 26 which extends substantially the full length of the member 12 and is substantially perpendicular to the surface 18. The mounting or nailing flange 26 is formed with ramps 28 and 30 one on each side of the flange 26. These ramps each form one side of an undercut groove 32 and 34 respectively positioned between its ramp and the surface 18. These grooves 32 and 34 functions to cooperated with elements on additional parts of the structure to provide snap connections as will be described hereinbelow.

In the sill structure illustrated in FIG. 1, the main element 12, which in this case is the main sill element 12 is shown mounted (via the sub-sill 50 and spacers 70 as will be described below) in the window opening 36 of the wall structure 38 formed with an air space 40 along the outside face of the support wall structure 42 and the inside of a facing structure 44. The facing wall structure 44 forms the decorative and/or exposed face of the wall protecting the structural wall portion from the elements.

To mount the sill 12 in position, a tapered sub-sill 50 which provides important portion of the present invention is first mounted in the opening 36 with a support surface 52 resting on the bottom of the opening 36 and having its outer end 54 adjacent to the outside surface of the structural portion 42 i.e. at the air space 40. The upper surface 56 of the sub-sill 50 slopes at an acute angle to the support surface 52 so that in mounted position in the opening 36 the surface 56 slopes upwardly and inwardly into the opening 36 i.e. in toward the inside of the wall 38.

The sub-sill 50 is provided with an inner mounting flange 58 through which a connector 60 connects the sub-sill to the main sill 12. In the illustrated arrangement, the connector 60 is a screw (a plurality of screws) interconnecting the sub-sill 50 and main sill 12. The sub-sill is anchored to the main or support wall 42 by any suitable means in the illustrated arrangement, a screw 62 (plurality of screws 62) has been shown for making this connection.

In the wall structure, a sealing membrane 64 is positioned in the air space 40 and extends over substantially the full outer surface of the support wall 42. The membrane extends into the opening 36 over and overlies the sub-sill 50 to provide a seal for the sub-sill 50 and preferably extends right up to the top of the inner flange 58.

The plurality of spacers 70( generally less than 2 inches (50 cm) in length (measured parallel to the longitudinal axis of the sill 12 and/or sub-sill 50) are positioned in axially spaced relationship (relative to the sill 12 and/or sub-sill 50) in overlying relationship relative to the sloping surface 56 of the sub-sill 50. Each spacer 70 is formed with a supporting surface 72 which is in facing relationship to the surface 56 and sandwiches the membrane 64 between it and the surface 56 to clamp the membrane firmly in position.

Each spacer 70 is provided with a plurality of supporting ribs, a center rib 74 which rests against the surface 18 of the member 12, a outer rib 76, the upper end of which also rests against the surface 18 but which also is provided with a rib 78 that is received within the cavity 32 on the flange 26. The inner end of each spacer 70 is provided with a gripping flange or rib 80 that is provided with a slot 82 adapted to receive a tongue 22 falls in the cavity 20 and is provided with a tab 84 that is received in the cavity 20 and bears against the surface 20A of the cavity 20 and forms the upper wall of the slot 80.

Before the member 12 is mounted on the sub-sill 50, plurality of spacers 70 are snapped into position by positioning the groove 82 onto the rib 22 and then forcing the spacers 70 so that the flange or rib 76 at its free end engages the ramp 28 on the flange 26 of the main sill 12 is deflected so the projection 78 snaps into the undercut 32 to lock the spacer 70 into position.

A compressible seal or gasket 90 is preferably mounted on the main element 12 (i.e. for the sill and the jam) by a snap fit (see FIGS. 1, 2 and particularly FIG. 3) via a flange 92 that is received within an axially extending groove 94 in the member 12 positioned adjacent to junction between the surface 18 and the projecting flange or outside flange 16 and a deflectable rib or flange 96 at its inner side. This flange or rib 96 is deflected by the ramp 30 cooperating with the surface 98 of the undercut portion 100 to deflect the flange 96 and position the undercut portion 100 within the groove 34 and form a snap fit between the seal element 90 and the main element 12.

The seal element or gasket element 90 is formed with a plurality of flexible sealing ribs or the like 102 that extend therefrom and are positioned to contact the adjacent surface 104 or the facing portion 44 of the wall 38.

This type of seal member 90 is used along three sides of the window, i.e. the two jam portions and the sill to provide a seal on these three sides of the window between the frame member 12 and the facing wall portion 44.

With respect to sealing of the sill, sealing member 90 is replaced by a sealing member 90A substantially the same as member 90 but having a flashing member 106 that projects downwardly from sealing member 90A and outward relative to the wall 38. The flashing member 106 directs water away from the wall 38.

In the FIGS. 3 and 4 embodiments, the ribs or the like 102 all extend from the main portion of the snap-in seal 90, however, in the FIG. 1 embodiment where the snap-in seal 90A also functions as flashing one of the flexible sealing members have been shown as being connected to the extension of the seal forming the flashing 106.

Referring to FIG. 4 where the member 12 is used as a head, it is used in combination with an upper head flashing element 200 which is formed by a continuous extrusion having an outer flange 202 which rests in face to face relationship with the flange 16 of the member 12 and with a mounting flange 204 extending substantially parallel thereto at the opposite side of the element 200. The flange 204 is adapted to extend up the wall face 66 and is connected thereto by suitable screws 206. The mounting flange has an indented surface portion 204A that extends over and is adapted to receive the mounting element 26 of the member 12. The flange 204 also has a projecting element 208 over the water sealing membrane 64 passes to cover the connecting screws or connectors 206 and thus seal the system.

The flashing 200 is formed with a top member having a downward and outwardly sloping surface 210 to direct any moisture out from within the cavity 40.

In the illustrated arrangement, suitable support members and the like as indicated for example at 212, form part of the member 200 to provide the required strength characteristics and the member 200.

At the inner ends of the head and jams, a suitable rod 220 and cocking 222 is used to provide a seal and the membrane 64 or a portion of the membrane 64 is extended as indicated at 64A for the head in FIG. 4 and is seal to the inner vapor barrier 230 as schematically illustrated at 232.

Referring back to FIGS. 1 and 2 (the sill assembly), in this arrangement, the vapor barrier 230 is sealed directly to the rearwardly projecting flange 240 of the sub-sill 50 as indicated by the seal 242 so that the membrane 64 is sealed to the flange 78 and the vapor barrier 230 is sealed to the flange 240 of the sub-sill 50 and thereby provide a substantially complete seal around the structural wall 42 at the window opening.

It will be apparent that suitable drain holes will be provided in the main member 12 as required depending on the application.

Having described the invention, modifications will be evident to those skilled in the art without departing from the scope of the invention as defined in the appended claims.

What is claimed is:

1. A window frame comprising a sub-sill having a mounting surface for positioning in a window opening in a wall and a sloping surface extending in an acute angle from the side of the sub-sill that faces outward relative to the window opening when the sub-sill is mounted in the window opening, a plurality of discreet spacer elements overlie said sub-sill and are positioned in axially spaced relationship relative to a longitudinal axis of the sub-sill, a main sill having a main mounting surface, cooperating fastening elements on said main mounting surface and said spacers for connecting each said spacer to said main sill and positioning said main sill substantially parallel to said mounting surface and means for connecting said main sill to said sub-sill, wherein said window frame further comprises a compression gasket, said compression gasket having a rib at one end and a deflectable element at its opposite end, a groove in said main sill in which said rib is received when said gasket is mounted on said main sill and an undercut on said main sill into which said deflectable element is snapped over when said gasket is mounted on said main sill.

2. A window frame structure as defined in claim 1 wherein, said cooperating fastening elements providing the connection between said spacers and said main sill comprise a snap fit between an arm at one end of each of said spacers and a tongue and groove connection between said main sill and a second arm on each of said spacer adjacent an opposite end of said spacer.

3. A window frame structure as defined in claim 2 wherein said main sill has an axially extending nailing strip projecting downwardly therefrom and said snap fit between said one arm and said main sill employs an undercut on said nailing strip.

4. A window frame structure as defined in claim 3 wherein, said gasket includes plurality of deformable strips interconnected with said gasket and adapted to contact an upper surface of a facing portion of a wall.

5. A window frame structure as defined in claim 4 wherein, said compression gasket includes a flashing member projecting forward therefrom.

6. A window frame structure as defined in claim 2 wherein, said gasket includes plurality of deformable strips interconnected with said gasket and adapted to contact an upper surface of a facing portion of a wall.

7. A window frame structure as defined in claim 6 wherein, said compression gasket includes a flashing member projecting forward therefrom.

8. A window frame structure as defined in claim 1 wherein, said gasket includes plurality of deformable strips interconnected with said gasket and adapted to contact an upper surface of a facing portion of a wall.

9. A window frame structure as defined in claim 8 wherein, said compression gasket includes a flashing member projecting forward therefrom.

10. A wall structure having an air space positioned between a structural wall portion and a facing wall portion, a window opening in said wall structure, a window frame including a sub-sill having a mounting surface and a sloping support surface extending at an acute angle from said mounting surface, said sub-sill mounted on said structural wall portion with said support surface sloping upward and inward relative to said window opening, a sealing membrane extending in said air space and positioned against said structural wall portion and passing over said sloping face of said sub-sill to provide a seal for said structural wall portion, a plurality of spaced tapered spacer elements positioned in overlying relationship to said sloping support surface and said membrane and extending up said sloping support surface, cooperating fastening elements connecting each of said spacer members to a main sill member and a connector connecting said main sill member to said sub-sill member.

11. A wall structure as defined in claim 10 wherein said main sill member has an axially and downwardly extending nailing flange that passes into said air space and is positioned against said membrane immediately adjacent to said window opening in said air space.

12. A wall structure as defined in claim 11 wherein, said wall structure further includes a compressible gasket and a releasable connection connecting said compressible seal to said main seal.

13. A wall structure as defined in claim 12 wherein, said compressible gasket includes a flashing projecting outwardly of said wall.

* * * * *